US008295729B2

(12) United States Patent
Okauchi

(10) Patent No.: US 8,295,729 B2
(45) Date of Patent: Oct. 23, 2012

(54) IMAGE FORMING DEVICE LINKABLE TO AN OPTIONAL UNIT

(75) Inventor: Yoshifumi Okauchi, Osaka (JP)

(73) Assignee: Kyocera Document Solutions Inc. (JP)

( * ) Notice: Subject to any disclaimer, the term of this patent is extended or adjusted under 35 U.S.C. 154(b) by 389 days.

(21) Appl. No.: 12/719,957

(22) Filed: Mar. 9, 2010

(65) Prior Publication Data

US 2010/0232812 A1 Sep. 16, 2010

(30) Foreign Application Priority Data

Mar. 11, 2009 (JP) ..... P2009-057286

(51) Int. Cl.
*G03G 15/00* (2006.01)

(52) U.S. Cl. ..... 399/90; 399/107

(58) Field of Classification Search ..... 399/88, 399/90, 107, 110

See application file for complete search history.

(56) References Cited

U.S. PATENT DOCUMENTS

| | | | | |
|---|---|---|---|---|
| 5,881,333 | A * | 3/1999 | Takahashi et al. | 399/90 |
| 7,099,605 | B2 * | 8/2006 | Namiki | 399/88 |
| 7,113,721 | B2 * | 9/2006 | Kitozaki | 399/110 |
| 7,333,745 | B2 * | 2/2008 | Han et al. | 399/88 |

FOREIGN PATENT DOCUMENTS

| | | |
|---|---|---|
| JP | H06-23946 | 3/1994 |
| JP | H07-295319 | 11/1995 |

* cited by examiner

*Primary Examiner* — William J Royer
(74) *Attorney, Agent, or Firm* — Ostrolenk Faber LLP

(57) ABSTRACT

An image forming device, which is linkable to an optional unit, includes: a connector providing an electrical connection with the optional unit; a connector cover opening and closing a connecting surface of the connector; and a cover opening-and-closing mechanism opening the connecting surface of the connector by moving the connector cover in accordance with a linking operation linking the optional unit.

9 Claims, 6 Drawing Sheets

IMAGE FORMING DEVICE LINKABLE TO AN OPTIONAL UNIT

The present application claims priority on Japanese Patent Application No. 2009-057286, filed Mar. 11, 2009, the content of which is incorporated herein by reference.

BACKGROUND OF THE INVENTION

1. Field of the Invention

The present invention relates to an image forming device to which an optional unit such as a paper feeder (PF) can be attached as an extension unit. Examples of the image forming device include a copying machine and a printer.

2. Description of the Related Art

Image forming devices such as a copying machine and a printer form an image on paper based on electrophotography. According to such image forming devices, an electrostatic latent image is formed on an image carrier such as a photoconductive drum. This electrostatic latent image is developed by a developing device using a toner which is a developer.

In this way, the electrostatic latent image is visualized as a toner image. This toner image on the image carrier is transferred to paper using transfer equipment such as a transfer roller. Then, the paper, to which the toner image was transferred, is transported to a fixing device. The toner image is heated and pressurized by this fixing device. The toner image is then fixed to the paper. The paper, to which the toner image was fixed, is discharged outside the image forming device. In this way, an image forming process is completed.

Some types of the image forming device can accommodate an optional unit such as a paper feeder (PF) which is attached to the image forming device based on a user's needs. When the optional unit is a paper feeder, the image forming device is connected to the paper feeder by stacking the image forming device onto the paper feeder which is placed on a floor. In addition, a connector electrically connects the image forming device with the paper feeder.

Incidentally, when the connector is provided on a bottom surface of the image forming device, a tracking phenomenon may occur after a line is connected, due to dust that has accumulated on the connector. A possible solution to this type of problem is to provide a connector cover which opens and closes a connecting surface of the connector, and to keep the connecting surface of the connector closed with the connector cover when the connector is not used. In this case, the connector cover is opened after the image forming device is connected to the paper feeder and the like. Then, the connecting surface of the connector is opened, and thus the image forming device and the paper feeder are electrically connected.

Japanese Published Patent No. H7-295319 (hereinafter, referred to as "Related Art Document 1"), for example, discloses a configuration regarding the connection between an image forming device and an optional unit. According to Related Art Document 1, a connector is provided on at least one of the image forming device or the optional unit. As the locations of the image forming device and the optional unit are determined and the connection between the image forming device and the optional unit is made, this connector is moved to a position at which the connection is made (i.e., the "connecting position"). This connector is connected to another connector provided on the other device.

In addition, Japanese Unexamined Utility Model Application, First Publication No. H6-23946 (hereinafter, referred to as "Related Art Document 2") discloses a configuration in which a positioning pin is provided at a frontal portion of a bottom surface of an image forming device. An optional unit is attached from the lower side of this image forming device. This optional unit is a bottom cassette holder. On the upper surface of this optional unit, a positioning guide is provided. The positioning guide includes a V-shaped notch, which leads the positioning pin at the frontal portion of the image forming device toward the notch. Thus, the positioning pin is received and is latched at the bottom part of the notch in the frontal side at the matching position.

Thus, according to one of the configurations described above, the connector is opened and closed by the connector cover. However, even if this configuration is applied, the connector cover may be kept open when the image forming device is not connected to an optional unit such as a paper feeder. In other words, when the connector provided on the image forming device is not used, the connector cover may be left open. In such cases, dust may accumulate on the connector, and a tracking phenomenon may be triggered.

Furthermore, when the image forming device is connected to the optional unit such as a paper feeder, the guiding pin provided on the optional unit may hit the connector provided on the image forming device. As a result, a crack may be formed on the connector housing, which may cause glitches such as abnormal heating. Neither Related Art Document 1 nor Related Art Document 2 provides a configuration that deals with dust accumulating on the connector. In addition, the guiding pin contacting the connector remains to be an unsolved problem. Considering the problems described above, the present invention aims to provide an image forming device such that a connector cover shuts and protects a connecting surface of a connector when the optional unit is not attached to the image forming device, and when the optional unit is attached to the image forming device, the connecting surface of the connector is opened in accordance with a connecting operation of the optional unit, thus providing an electrical connection with the optional unit.

SUMMARY OF THE INVENTION

The present invention is made considering the problems described above.

(1) An image forming device according to an aspect of the present invention is linkable to an optional unit, and includes: a connector, a connector cover, and a cover opening-and-closing mechanism. The connector provides an electrical connection with the optional unit. The connector cover opens and closes a connecting surface of the connector. The cover opening-and-closing mechanism opens the connecting surface of the connector by moving the connector cover in accordance with a linking operation linking the optional unit.

(2) An image forming device according to the above aspect of the present invention further includes a guiding hole. A guiding pin protruding from the optional unit penetrates the guiding hole. When the optional unit is linked, the connecting surface of the connector is opened by the cover opening-and-closing mechanism converting an insertion movement into a sliding movement of the connector cover. During the insertion movement, the guiding pin is inserted through the guiding hole.

(3) An image forming device according to the above aspect of the present invention further includes a cap, an urging member, and a rod. The cap is provided upright and surrounds the guiding hole. The urging member urges the connector cover in a direction in which the connector cover closes. The rod includes a rotatably supported end. The rod penetrates an elongated hole on the cap. Another end of the rod is connected to the connector cover through a wire.

(4) An image forming device according to the above aspect of the present invention may be configured as follows: the cover opening-and-closing mechanism opens the connecting surface of the connector by a cam mechanism converting the linking operation, linking the optional unit, into an opening movement of the connector cover.

(5) An image forming device according to the above aspect of the present invention may be configured as follows: the optional unit is a paper feeder.

(6) An image forming device according to the above aspect of the present invention may be configured as follows: the cover opening-and-closing mechanism opens the connecting surface of the connector by a lever mechanism converting the linking operation, linking the optional unit, into an opening movement of the connector cover.

EFFECTS OF THE INVENTION

According to the present invention described in (1) above, the connecting surface of the connector is closed by the connector cover when the optional unit and the image forming device are not connected, and when the connector provided on the image forming device is not used. This configuration prevents abnormalities that occur due to the accumulation of dust on the connector, such as tracking phenomena. A cover opening-and-closing mechanism operates the connector cover and opens the connecting surface of the connector in accordance with the linking operation of the image forming device and the optional unit. As a result, the connector can be used to electrically connect the image forming device easily with the optional unit. At the same time, the guiding pin provided on the optional unit is prevented from contacting the connector.

Further, the connector is prevented from being damaged. Abnormal heating due to such damage of the connector is also prevented.

According to the present invention described in (2) above, the linear insertion movement of the guiding pin into the guiding hole, when linkage to the optional unit is made, is converted to a sliding movement of the connector cover. Thus, the connecting surface of the connector is opened. As a result, a contact between the guiding pin and the connector is prevented reliably.

According to the present invention described in (3) above, at the time of linkage to the optional unit, when the guiding pin protruding from the optional unit is inserted inside the cap from the guiding hole on the image forming device, the guiding pin engages with the rod inserted in the cap. Thus, the rod rotates around one end of the rod. A wire is connected to the other end of the rod. The connecting surface of the connector can be opened by sliding the connector cover against the urging force of the urging part. In this way, the image forming device can be electrically connected to the optional unit by opening the connecting surface of the connector in accordance with the linking operation of the image forming device and the optional unit.

According to the present invention described in (4) above, the linkage operation of the optional unit is converted to an opening movement of the connector cover by a simple cam mechanism.

According to the present invention described in (5) above, the image forming device and the paper feeder can be electrically connected by opening the connecting surface of the connector in accordance with the linking operation of the image forming device and the paper feeder. The paper feeder is an optional unit.

BRIEF DESCRIPTION OF THE DRAWINGS

FIG. 4 is a partial perspective view seen from a lower surface side of an image forming device.

FIG. 5 is a partial perspective view seen from a lower surface side of an image forming device.

DETAILED DESCRIPTION OF THE PREFERRED EMBODIMENTS

Hereinafter, an image forming device 1 according to a first embodiment of the present invention is described with reference to the attached figures.

Figure 1:
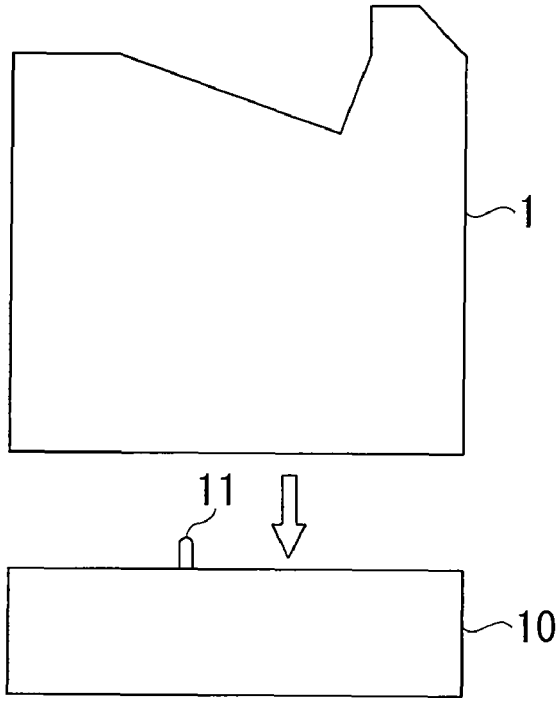
FIG. 1 is a side view representing a linking operation of an image forming device according to an aspect of the present invention to an optional unit.
Figure 2:
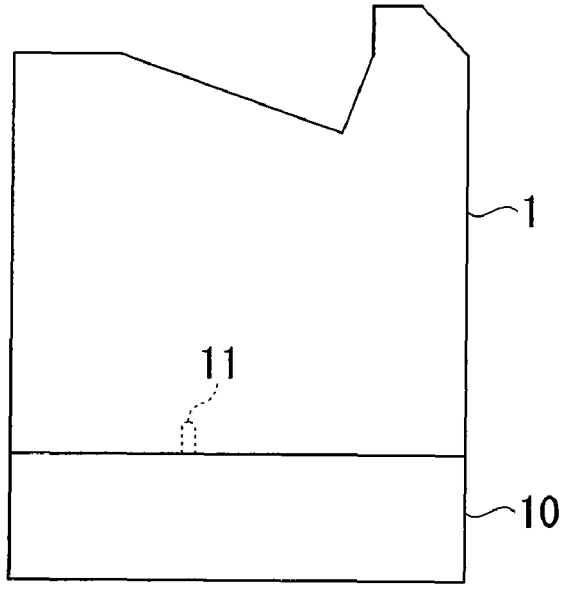
FIG. 2 is a side view representing an image forming device according to the above configuration linked to an optional unit.

FIG. 1 is a side view showing a linking operation of an image forming device 1 according to the present invention to an optional unit. FIG. 2 is a side view showing a condition in which the image forming device 1 is linked to the optional unit.

In this first embodiment described below, a paper feeder (PF) 10 is linked to the image forming device 1 as an optional unit.

The paper feeder 10 is placed horizontally on a floor surface. As shown in FIG. 1, the image forming device 1 is stacked on top of this paper feeder 10. Thus, the image forming device 1 and the paper feeder 10 are linked together as shown in FIG. 2. In this way, the paper feeder 10 is attached to a lower portion of the image forming device 1 as an extension. Incidentally, a guiding pin 11 is provided upright on an upper surface of the paper feeder 10. When the image forming device 1 is stacked on top of the paper feeder 10, and the image forming device 1 and the paper feeder 10 are linked together, the guiding pin 11 fits into a fitting hole formed on a bottom surface of the image forming device 1. Thus, the image forming device 1 is positioned precisely with respect to the paper feeder 10.

Incidentally, a cover opening-and-closing mechanism is provided on the image forming device 1 according to the present invention. A connector cover 3 opens and closes a connecting surface of a connector 2 of the image forming device 1. The cover opening-and-closing mechanism operates the connector cover 3 in accordance with a linking movement linking the image forming device 1 to the paper feeder 10. Thus, the cover opening-and-closing mechanism opens the connecting surface of the connector 2. An embodiment of this cover opening-and-closing mechanism is described hereunder.

Figure 3:
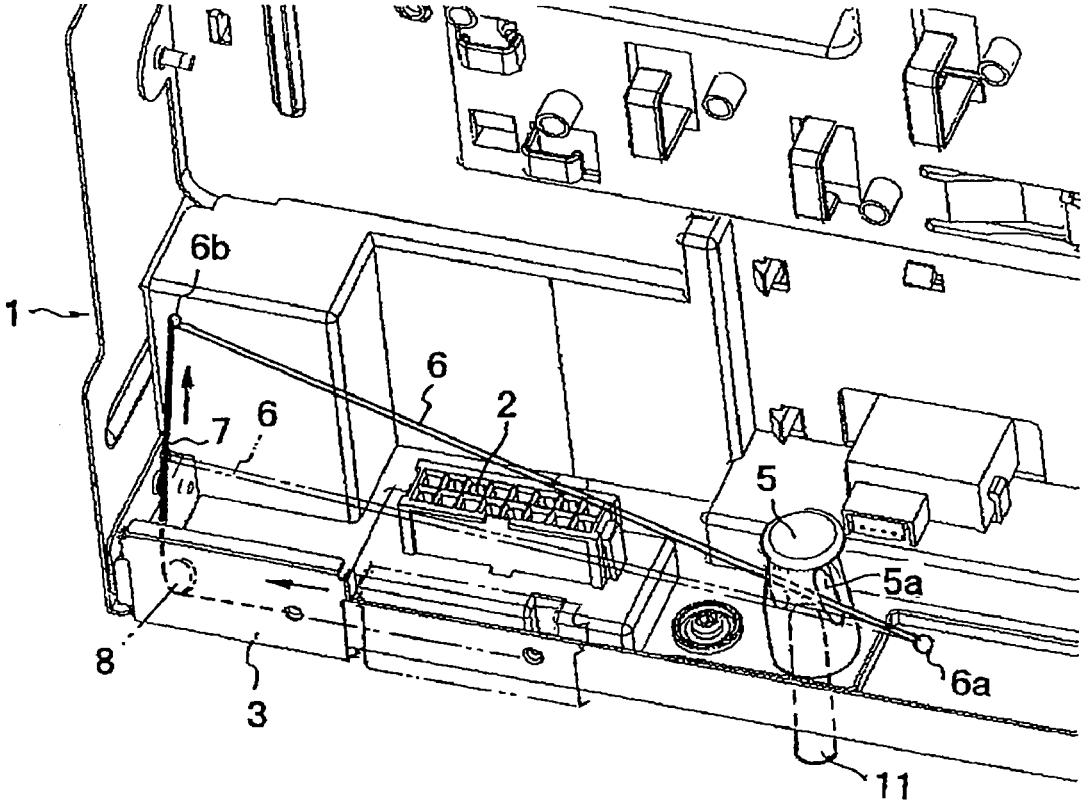
FIG. 3 is a partial perspective view of an interior portion of an image forming device representing a configuration of a cover opening-and-closing mechanism according to the above embodiment.
Figure 4:
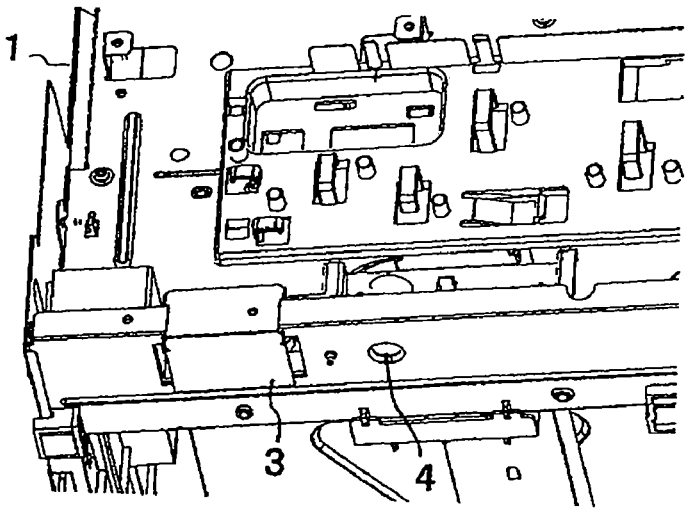
FIG. 4 is a partial perspective view showing a condition in which a connector cover according to the above aspect of the present invention is closed. This
Figure 5:
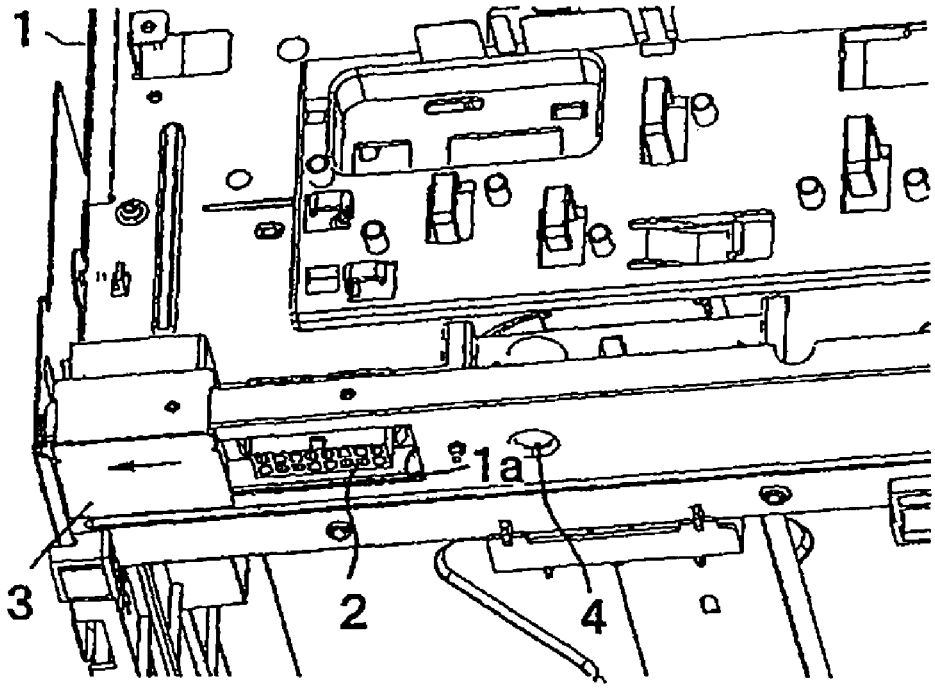
FIG. 5 is a partial perspective view showing a condition in which a connector cover according to the above aspect of the present invention is opened. This

FIG. 3 is a partial perspective view of an interior portion of the image forming device 1 representing a configuration of the cover opening-and-closing mechanism. FIGS. 4 and 5 are partial perspective views showing a condition in which the connector cover 3 is opened or closed by the cover opening-and-closing mechanism. FIGS. 4 and 5 are partial perspective views seen from a lower surface side of the image forming device 1. FIG. 4 shows a condition in which the connecting surface of the connector 2 is closed by the connector cover 3. FIG. 5 shows a condition in which the connecting surface of the connector 2 is opened by the connector cover 3.

As shown in FIG. 3, a connector 2 is provided on a bottom portion of an interior part of a main body of the image forming device 1. The connector 2 electrically connects the image forming device 1 with the paper feeder 10 shown in FIGS. 1 and 2. As shown in FIG. 5, the connecting surface of the connector 2 opens toward a rectangular concave part 1*a* formed on a bottom surface of the main body of the image forming device 1. The connecting surface of the connector 2 is opened and closed by an L-shaped connector cover 3. The connector cover 3 slides along the bottom portion of the main body of the image forming device 1. Due to the cover opening-and-closing mechanism, the connector cover 3 opens in accordance with a linking operation linking the image forming device 1 and the paper feeder 10.

As shown in FIGS. 4 and 5, a circular fitting hole 4 is formed near a section of the bottom surface of the main body of the image forming device 1 at which the connecting surface of the connector 2 is exposed. The guiding pin 11, placed upright on the upper surface of the paper feeder 10, is inserted in the fitting hole 4. As shown in FIG. 3, a cap 5 is provided upright on the bottom portion of the main body inside the image forming device 1 so as to surround the fitting hole 4.

A long hole 5*a*, elongated in the upper and lower longitudinal direction, is formed on a surrounding wall of the cap 5 at certain places so that a pair of long holes 5*a* are facing each other. A rod 6 is inserted in these long holes 5*a*. When the image forming device 1 links with the paper feeder 10, an upper end of the guiding pin 11 provided on the paper feeder 10 engages with a portion of the rod 6 which runs through the cap 5. One end 6*a* of the rod 6 is rotatably linked to the bottom portion of the main body inside the image forming device 1. Another end 6*b* of the rod 6 extends toward a side portion of the main body inside the image forming device 1.

Further, as shown in FIG. 3, an end of a wire 7 is linked to the connector cover 3. The wire 7 is wrapped around a pulley 8 rotatably supported by the connector cover 3. Thus, the wire 7 extends upwards. An end part of the wire 7 is linked to the another end part 6*b* of the rod 6. By the way, the connector cover 3 is constantly urged by a return spring (not diagrammed) in a direction in which the connector cover 3 closes. When the image forming device 1 is not linked to the paper feeder 10, and when the connector 2 is not used, the connector cover 3 is placed at a position shown in FIG. 3 by a dashed line. As shown in FIG. 4, the connector cover 3 protects the connecting surface of the connector 2 by closing the connecting surface. Thus, the connector cover 3 prevents dust from entering the connecting surface of the connector 2.

The cover opening-and-closing mechanism includes the cap 5, the rod 6, the wire 7, the pulley 8, and the return spring (not diagrammed) described above. When the image forming device 1 is attached to the paper feeder 10 as shown in FIG. 2 by stacking the image forming device 1 on top of the paper feeder 10 and linking the image forming device 1 with the paper feeder 10, the guiding pin 11 of the paper feeder 10 is inserted to the fitting hole 4 of the image forming device 1 from below. When a tip of the guiding pin 11 enters the cap 5, a portion of the rod 6 which penetrates the cap 5 is lifted upwards by the tip of the guiding pin 11. Then, the rod 6 is pushed upwards around the end 6*a*. In addition, the rod 6 pulls the wire 7, linked to the another end 6*b*, towards an upper side. Thus, the connector cover 3, which was placed in the position shown with a dashed line in FIG. 3 and was closing the connecting surface of the connector 2 (see FIG. 4), slides along the arrow drawn in FIG. 3 to a position shown in FIG. 3 with a solid line. In this way, the connecting surface of the connector 2 is exposed as shown in FIG. 5. When the connecting surface of the connector 2 is opened and exposed, the image forming device 1 and the paper feeder 10 can be electrically connected by forming a wire connection between the image forming device 1 and the paper feeder 10 using the connector 2.

As described above, according to the present embodiment, when the image forming device 1 is not linked to the paper feeder 10 and when the connector 2 formed on the image forming device 1 is not used, the connecting surface of the connector 2 is closed by the connector cover 3 (see FIG. 4). As a result, it is possible to avoid glitches such as a tracking phenomenon occurring due to dust accumulating on the connector 2.

In addition, the connecting surface of the connector 2 is opened and exposed by the cover opening-and-closing mechanism sliding the connector cover 3 in accordance with a linking movement linking the image forming device 1 to the paper feeder 10 (see FIG. 5). As a result, an electrical connection between the image forming device 1 and the paper feeder 10 can be made easily using the connector 2. In addition, the guiding pin 11 provided on the paper feeder 10 is prevented from contacting the connector 2 provided on the image forming device 1. Further, it is possible to prevent the connector 2 from being damaged. An abnormal heating occurring due to the damage is prevented as well.

Next, a cover opening-and-closing mechanism according to a second embodiment of the present invention is described with reference to FIGS. 6A to 6C.

Figure 6A:
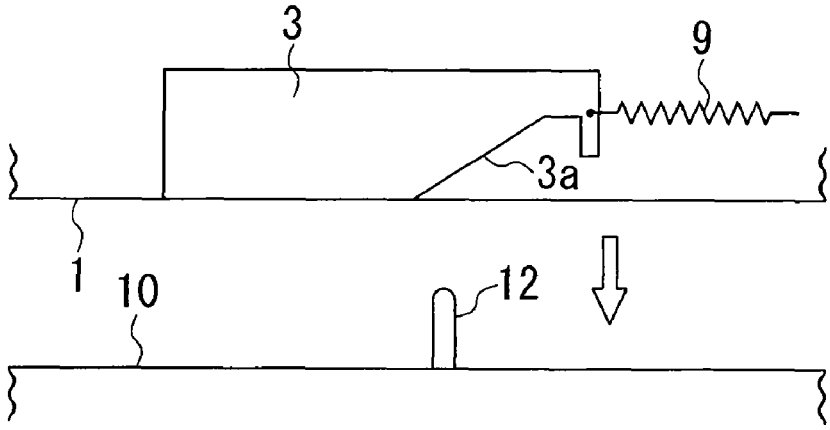
FIG. 6A is a partial side view showing a configuration and an operation of a cover opening-and-closing mechanism according to a different aspect of the present invention.
Figure 6B:
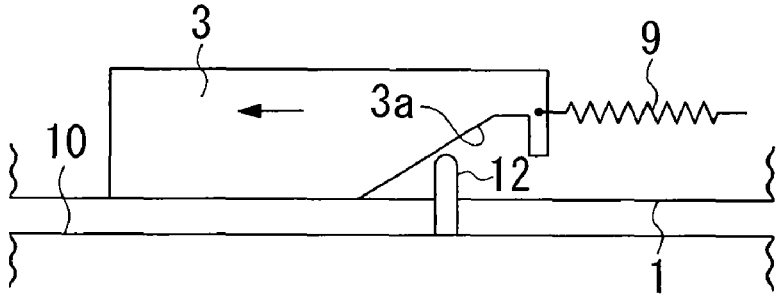
FIG. 6B is a partial side view showing a configuration and an operation of a cover opening-and-closing mechanism according to a different aspect of the present invention.
Figure 6C:
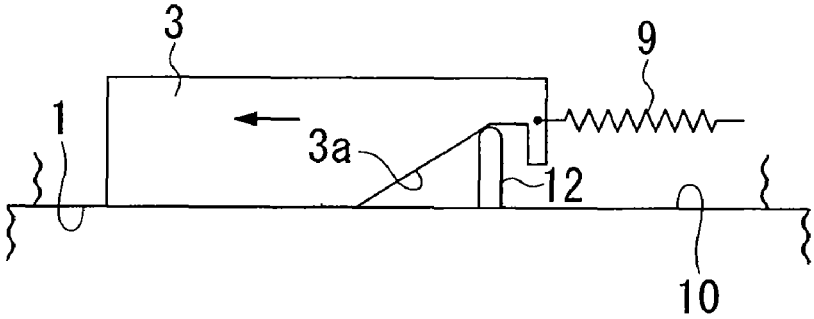
FIG. 6C is a partial side view showing a configuration and an operation of a cover opening-and-closing mechanism according to a different aspect of the present invention.

FIGS. 6A to 6C are partial side views showing a configuration and an operation of the cover opening-and-closing mechanism according to the above second embodiment of the present invention. The cover opening-and-closing mechanism includes a cam face 3*a*, an engaging pin 12, and a return spring 9. The cam face 3*a* is a slope formed on the connector cover 3. The engaging pin 12 protrudes from the paper feeder 10. The return spring 9 constantly urges the connector cover 3 in a direction in which the connector cover 3 closes (in other words, towards the right side in FIG. 6). The cam mechanism includes the cam surface 3*a* formed on the connector cover 3 and the engaging pin 12 which engages with the cam surface 3*a*.

Incidentally, when the paper feeder 10 is attached to the image forming device 1 as an optional unit, the image forming device 1 is stacked on top of the paper feeder 10. As shown in FIG. 6A, before the image forming device 1 is stacked onto the paper feeder 10, the engaging pin 12 on the paper feeder 10 is not engaged with the cam surface 3*a* formed on the connector cover 3 of the image forming device 1. Under this condition, the connector cover 3 is urged by the return spring 9 towards a direction in which the connector cover 3 closes. Thus, the connector cover 3 is placed at a position shown in FIG. 6A. In this way, the connector cover 3 closes the connecting surface of the connector (not diagrammed) which is exposed on the bottom surface of the image forming device 1.

When the image forming device 1 is lowered towards the paper feeder 10 from the condition described above, the engaging pin 12 of the paper feeder 10 engages with the cam surface 3*a* of the connector cover 3 as shown in FIG. 6B. Thus, the connector cover 3 slides due to a camming action in the direction of the arrow shown in FIG. 6B. In this way, the connector cover 3 gradually opens the connecting surface of the connector.

When the image forming device 1 is stacked completely on top of the paper feeder 10, and the image forming device 1 is linked with the paper feeder 10, the connector cover 3 slides in the direction of the arrow shown in FIG. 6C. Thus, the connector cover 3 completely opens the connecting surface of the connector.

In the present second embodiment, the cover opening-and-closing mechanism slides the connector cover 3 and exposes the connecting surface of the connector in accordance with the linking operation linking the image forming device 1 with the paper feeder 10. Thus, the same effect obtained in the first embodiment can be attained in the second embodiment as well. In particular, according to the present second embodiment, the connecting surface of the connector can be exposed by a simple cam mechanism converting the linking operation, linking the image forming device 1 to the paper feeder 10, into an opening operation, opening the connector cover 3.

Next, a cover opening-and-closing mechanism according to a third embodiment of the present invention is described with reference to FIGS. 7A to 8B. FIGS. 7A to 8B are diagrams representing a configuration and an operation of the cover opening-and-closing mechanism according to the present embodiment. An image forming device 20 is stacked on top of a paper feeder 40. The paper feeder 40 is placed on a floor surface. A connector 22 is provided on the image forming device 20. The connector 22 is placed adjacent to a bottom surface 21. An opening part 21*a* is provided on the bottom surface 21 so that the paper feeder 40 can be electrically connected to a portion opposing the connector 22. This electrical connection is made in a direction perpendicular to the connector 22. A cover opening-and-closing mechanism 30 is provided on the opening part 21*a*. The cover opening-and-closing mechanism 30 performs an opening operation and a closing operation in accordance with the image forming device 20 stacking on top of the paper feeder 40.

The cover opening-and-closing mechanism 30 includes a connector cover 31, a lever part 32, and a return spring 33. The connector cover 31 includes a substantially rectangular flat part 31*a*. The flat part 31*a* is large enough to cover the opening part 21*a*. A click part 31*b* is provided on each of one pair of opposing sides of the flat part 31*a*. The click part 31*b* protrudes upwards and outwards. In addition, a linking hole 31*c* is formed on the flat part 31*a*. The linking hole 31*c* is shaped like an elongated hole. The linking hole 31*c* may be a groove on the elongated hole. The connector cover 31 is a material with more or less elasticity. The flat part 31*a* and the click part 31*b* are provided on the outer side of the bottom surface 21, so that a rim of the bottom surface 21 is sandwiched in between each of the flat part 31*a* and the click part 31*b*. The distance between the flat part 31*a* and the click part 31*b* is somewhat larger than the thickness of the bottom surface 21. Therefore, the connector cover 31 can slide along the rim of the bottom surface while being affixed to the opening part 21*a*.

The lever part 32 includes a supporting hole 32*c*, a long arm 32*a*, and a short arm 32*b*. The supporting hole 32*c* is used to rotatably support the lever part 32. The two arms 32*a* and 32*b* extend from the supporting hole 32*c* to a predetermined radial direction. In addition, in the vicinity of a tip of the long arm 32*a*, a cylindrical linking pin 32*d* protrudes in an axial direction of the supporting hole 32*c*. Meanwhile, a sloping surface 32*e* is formed at a tip part of the short arm 32*b*. The sloping surface 32*e* is a plane sloping so as to overhang in a rotating direction around the supporting hole 32*c*. A supporting axis 22*a* is provided so as to protrude towards an inner side of the bottom surface 21. The lever part 32 is rotatably fixed by the supporting hole 32*c* with respect to the supporting axis 22*a*. Here, the linking pin 32*d* is attached so as to link with the linking hole 31*c* of the connector cover 31. A torsion spring 23 is also fixed to the supporting axis 22*a*. One arm 23*a* of the torsion spring 23 engages with a hole (not diagrammed) provided on the bottom surface 21. Another arm 23*b* is fixed so as to engage with a surface in a rear side of the sloping surface 32*e* of the lever part 32. The lever part 32 is urged by the torsion spring 23 in a counter-clockwise direction in FIG. 7A. In addition, the connector cover 31 linked to the lever part 32 is urged so as to cover the opening part 21*a*.

A positioning pin 41 protrudes from an upper surface of the paper feeder 40. A tip of the positioning pin 41 is tapered. The positioning pin 41 is used to restrict the positions of the image forming device 20 and the paper feeder 40 when the image forming device 20 is stacked on top of the paper feeder 40. A positioning hole 21*b* is formed on the bottom surface 21 of the image forming device 20 so as to engage with the positioning pin 41.

Figure 7A:
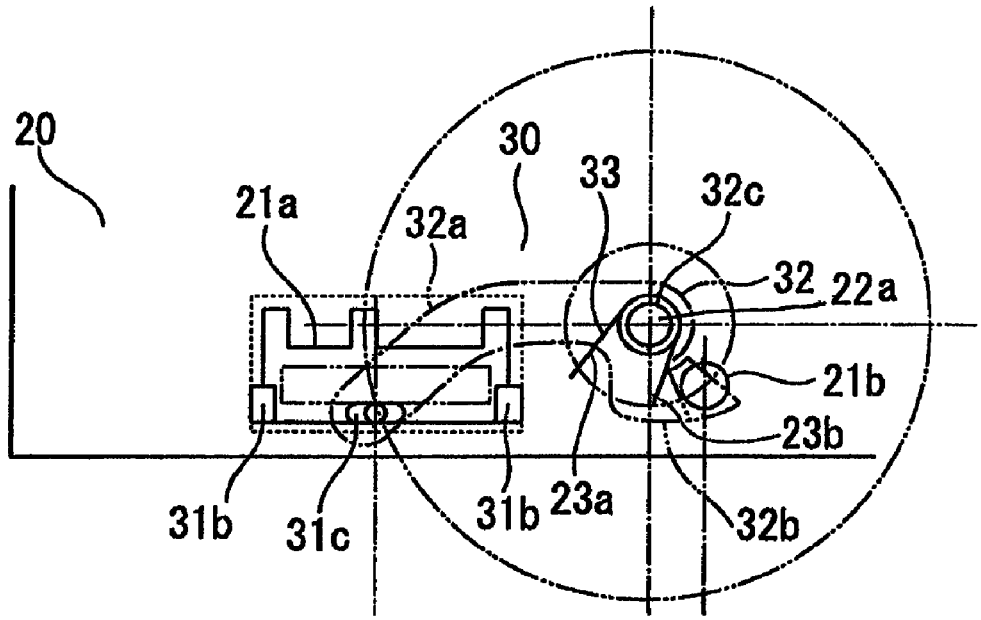
FIG. 7A is a plane view showing a condition in which a cover opening-and-closing mechanism according to a different aspect of the present invention is closed.
Figure 7B:
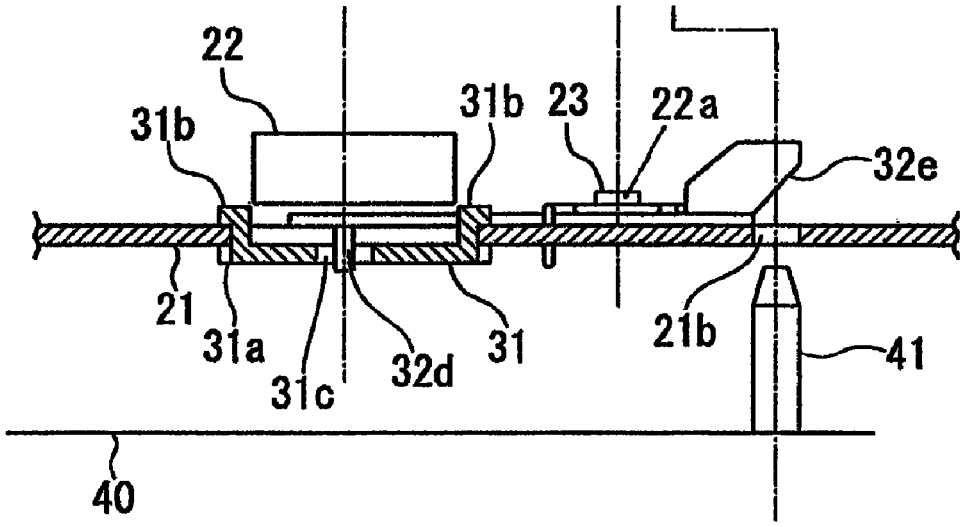
FIG. 7B is a side view showing a condition in which a cover opening-and-closing mechanism according to a different aspect of the present invention is closed.

Before the image forming device 20 is stacked on top of the paper feeder 40, the connector cover 31 is urged by the return spring 33 to be located at a closing side as shown in FIG. 7A. At this time, the sloping surface 32*e* of the lever part 32 is positioned above the positioning hole 21*b* of the bottom surface 21.

Figure 8A:
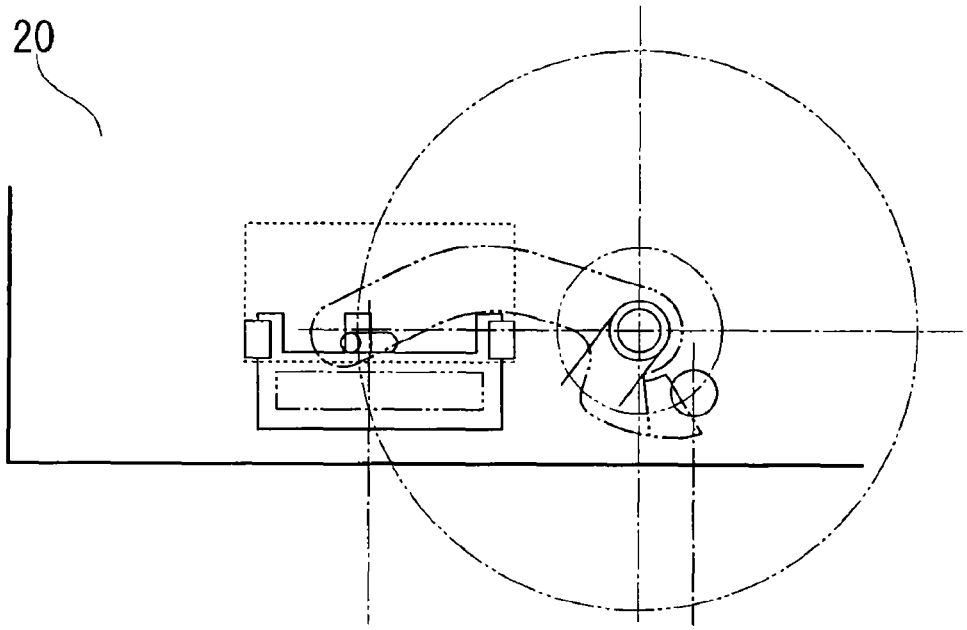
FIG. 8A is a plane view showing a condition in which a cover opening-and-closing mechanism according to a different aspect of the present invention is opened.
Figure 8B:
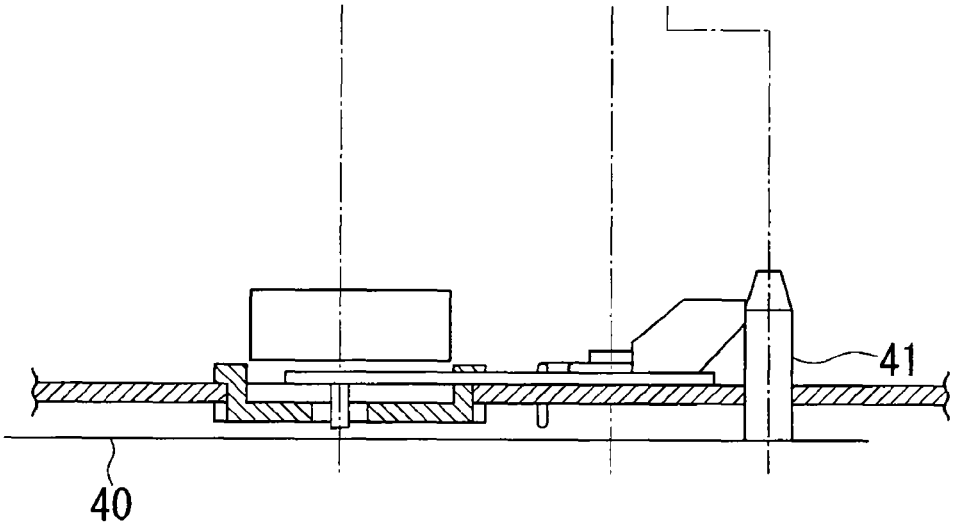
FIG. 8B is a side view showing a condition in which a cover opening-and-closing mechanism according to a different aspect of the present invention is opened.

When the image forming device 20 is lowered from this condition towards the paper feeder 40, the positioning pin 41 of the paper feeder 40 contacts the sloping surface 32*e* of the lever part 32. The positioning pin 41 pushes the sloping surface 32*e*, and the lever part 32 rotates in a clockwise direction in FIG. 7A. Accordingly, the connector cover 31 slides, and the opening part 21*a* opens gradually. When the image forming device 20 is completely stacked on top of the paper feeder 40, and the image forming device 20 is linked to the paper feeder 40, the connector cover 31 slides as shown in FIGS. 8A and 8B. Thus, the connecting surface of the connector 22 opens completely. The paper feeder 40 is then electrically connected to the connector 22.

As described above, according to the present third embodiment, the connecting surface of the connector 22 opens by a cover opening-and-closing mechanism 30 sliding the connector cover 31 in accordance with a linking operation linking the image forming device 20 to the paper feeder 40. Hence, the effects obtained in the first and second embodiments can be obtained in the present third embodiment as well. In particular, according to the present embodiment, a simple lever mechanism can convert a linking, linking the image forming device 20 to the paper feeder 40, into an opening movement of the connector cover 31. Thus, the connecting surface of the connector is opened and exposed.

Incidentally, in the above description, a paper feeder was linked to the image forming device as an optional unit. However, it is also possible to link other units such as a finisher or an automatic draft feeding device (ADF) as an optional unit. The present invention can be applied to an image forming device to which such optional units can be attached.

While a preferred embodiment of the present invention has been described above, it should be understood that these are exemplary of the invention and are not to be considered as limiting the present invention. Additions, omissions, substitutions, and other modifications can be made without departing from the scope of the present invention. The invention is not to be considered as being limited by the foregoing description, and is only limited by the scope of the appended claims.

What is claimed is:

1. An image forming device linkable to an optional unit, the image forming device comprising:

a connector providing an electrical connection with the optional unit;

a connector cover opening and closing a connecting surface of the connector; and a cover opening-and-closing mechanism opening the connecting surface of the connector by moving the connector cover in accordance with a linking operation linking the optional unit.

2. An image forming device according to claim 1, further comprising a guiding hole through which a guiding pin protruding from the optional unit penetrates, wherein when the optional unit is linked, the connecting surface of the connector is opened by the cover opening-and-closing mechanism converting an insertion movement, inserting the guiding pin through the guiding hole, into a sliding movement of the connector cover.

3. An image forming device according to claim 2, further comprising:

a cap provided upright and surrounding the guiding hole;

an urging member urging the connector cover in a direction in which the connector closes; and a rod comprising a rotatably supported end, wherein the rod penetrates an elongated hole on the cap; and another end of the rod is connected to the connector cover through a wire.

4. An image forming device according to claim 3, wherein the optional unit is a paper feeder.

5. An image forming device according to claim 2, wherein the cover opening-and-closing mechanism opens the connecting surface of the connector by a cam mechanism converting the linking operation, linking the optional unit, into an opening movement of the connector cover.

6. An image forming device according to claim 5, wherein the optional unit is a paper feeder.

7. An image forming device according to claim 2, wherein the optional unit is a paper feeder.

8. An image forming device according to claim 2, wherein the cover opening-and-closing mechanism opens the connecting surface of the connector by a lever mechanism converting the linking operation, linking the optional unit, into an opening movement of the connector cover.

9. An image forming device according to claim 1, wherein the optional unit is a paper feeder.

* * * * *